US012364331B2

(12) United States Patent
Chen et al.

(10) Patent No.: US 12,364,331 B2
(45) Date of Patent: Jul. 22, 2025

(54) SLIDE RAIL MECHANISM

(71) Applicants: KING SLIDE WORKS CO., LTD., Kaohsiung (TW); KING SLIDE TECHNOLOGY CO.,LTD., Kaohsiung (TW)

(72) Inventors: Ken-Ching Chen, Kaohsiung (TW); Hsiu-Chiang Liang, Kaohsiung (TW); Chun-Chiang Wang, Kaohsiung (TW)

(73) Assignees: KING SLIDE WORKS CO., LTD., Kaohsiung (TW); KING SLIDE TECHNOLOGY CO., LTD., Kaohsiung (TW)

( * ) Notice: Subject to any disclaimer, the term of this patent is extended or adjusted under 35 U.S.C. 154(b) by 231 days.

(21) Appl. No.: 18/220,287

(22) Filed: Jul. 11, 2023

(65) Prior Publication Data

US 2024/0268555 A1 Aug. 15, 2024

(30) Foreign Application Priority Data

Feb. 14, 2023 (TW) ..... 112105467

(51) Int. Cl.
*A47B 88/45* (2017.01)

(52) U.S. Cl.
CPC ..... *A47B 88/45* (2017.01)

(58) Field of Classification Search
CPC ..... A47B 88/45; A47B 88/467; A47B 88/50; E05B 65/463
USPC ..... 312/107.5, 216, 221
See application file for complete search history.

(56) References Cited

U.S. PATENT DOCUMENTS

| | | | | |
|---|---|---|---|---|
| 3,767,280 | A * | 10/1973 | McLaughlin | E05B 65/462 312/219 |
| 4,609,233 | A * | 9/1986 | Walla | E05B 65/462 70/120 |
| 5,352,030 | A * | 10/1994 | Derle | E05B 65/464 312/220 |
| 5,772,294 | A * | 6/1998 | Hendrich | E05B 65/464 312/334.8 |
| 6,186,606 | B1 * | 2/2001 | Krei | E05B 65/46 312/221 |
| 7,320,507 | B2 * | 1/2008 | White | E05B 65/464 312/217 |
| 9,907,400 | B1 | 3/2018 | Chen | |
| 2007/0046158 | A1 * | 3/2007 | Hoffman | A47B 88/467 312/333 |

FOREIGN PATENT DOCUMENTS

| | | | |
|---|---|---|---|
| EP | 1441092 | B1 | 11/2005 |
| EP | 1 500 763 | B1 | 2/2008 |

* cited by examiner

*Primary Examiner* — James O Hansen
(74) *Attorney, Agent, or Firm* — Winston Hsu

(57) ABSTRACT

A slide rail mechanism is provided and includes a first slide rail assembly, a second slide rail assembly and a connecting member. The first slide rail assembly includes a first rail and a second rail longitudinally displaceable with respect to the first rail. The second slide rail assembly includes a third rail and a fourth rail longitudinally displaceable with respect to the third rail. The connecting member is moved for preventing the fourth rail from displacing with respect to the third rail along an opening direction when the second rail displaces with respect to the first rail along the opening direction.

16 Claims, 11 Drawing Sheets

SLIDE RAIL MECHANISM

BACKGROUND OF THE INVENTION

1. Field of the Invention

The present invention relates to a slide rail product, and more specifically, to a slide rail mechanism capable of preventing two movable rails of two slide rail assemblies from being opened or extended simultaneously by a connecting member.

2. Description of the Prior Art

EP Patent No. 1441092 B1 discloses a blocking device adapted for a drawer cabinet. The drawer cabinet includes a cabinet body, a plurality of drawers and a plurality of slide rail assemblies. The blocking device includes a plurality of self-closing assemblies and a plurality of lifting members. Each of the plurality of self-closing assemblies is arranged on the corresponding drawer or the corresponding slide rail assembly and includes a driving member. When one of the plurality of drawers is opened with respect to the cabinet body, the one of the plurality of drawers drives an interlock mechanism formed by the plurality of lifting members by a blocking catch of a corresponding one of the plurality of driving members to block the other ones of the plurality of driving members for prevent the other ones of the plurality of drawers from being opened with respect to the cabinet body.

However, the aforementioned blocking device has complicated structure. To meet different requirements, it becomes an important topic to provide an improved slide rail product.

SUMMARY OF THE INVENTION

The present invention provides a slide rail mechanism capable of preventing two movable rails of two slide rail assemblies from being opened or extended simultaneously by a connecting member.

According to an aspect of the invention, a slide rail mechanism is adapted for a cabinet. The slide rail mechanism includes a first slide rail assembly, a second slide rail assembly and a connecting member. The first slide rail assembly is arranged on the cabinet. The first slide rail assembly includes a first rail and a second rail longitudinally displaceable with respect to the first rail. The second slide rail assembly is arranged on the cabinet. The second slide rail assembly includes a third rail and a fourth rail longitudinally displaceable with respect to the third rail. The connecting member is movably mounted on one of the cabinet and the first rail. The connecting member is moved for preventing the fourth rail from displacing with respect to the third rail along an opening direction when the second rail displaces with respect to the first rail along the opening direction.

According to another aspect of the invention, a slide rail mechanism includes a first slide rail assembly, a second slide rail assembly and a connecting member. The first slide rail assembly includes a first rail, a second rail longitudinally displaceable with respect to the first rail, and a self-closing device arranged on the first rail. The self-closing device includes a resilient member. The second slide rail assembly includes a third rail and a fourth rail longitudinally displaceable with respect to the third rail. The connecting member is moved for preventing the fourth rail from displacing with respect to the third rail along an opening direction and the resilient member is resiliently deformed during a displacement of the second rail with respect to the first rail from a retracted position to an extended position along the opening direction. The second rail is configured to be driven to the retracted position along a retracting direction by the resilient member during a displacement of the second rail with respect to the first rail from the extended position along the retracting direction.

DETAILED DESCRIPTION

In the following detailed description of the preferred embodiments, reference is made to the accompanying drawings which form a part hereof, and in which is shown by way of illustration specific embodiments in which the invention may be practiced. In this regard, directional terminology, such as "top", "bottom", "left", "right", "front", "back", etc., is used with reference to the orientation of the Figure (s)

being described. The members of the present invention can be positioned in a number of different orientations. As such, the directional terminology is used for purposes of illustration and is in no way limiting. Accordingly, the drawings and descriptions will be regarded as illustrative in nature and not as restrictive. Also, if not specified, the term "connect" is intended to mean either an indirect or direct mechanical connection. Thus, if a first device is connected to a second device, that connection may be through a direct mechanical connection, or through an indirect mechanical connection via other devices and connections.

Figure 1:
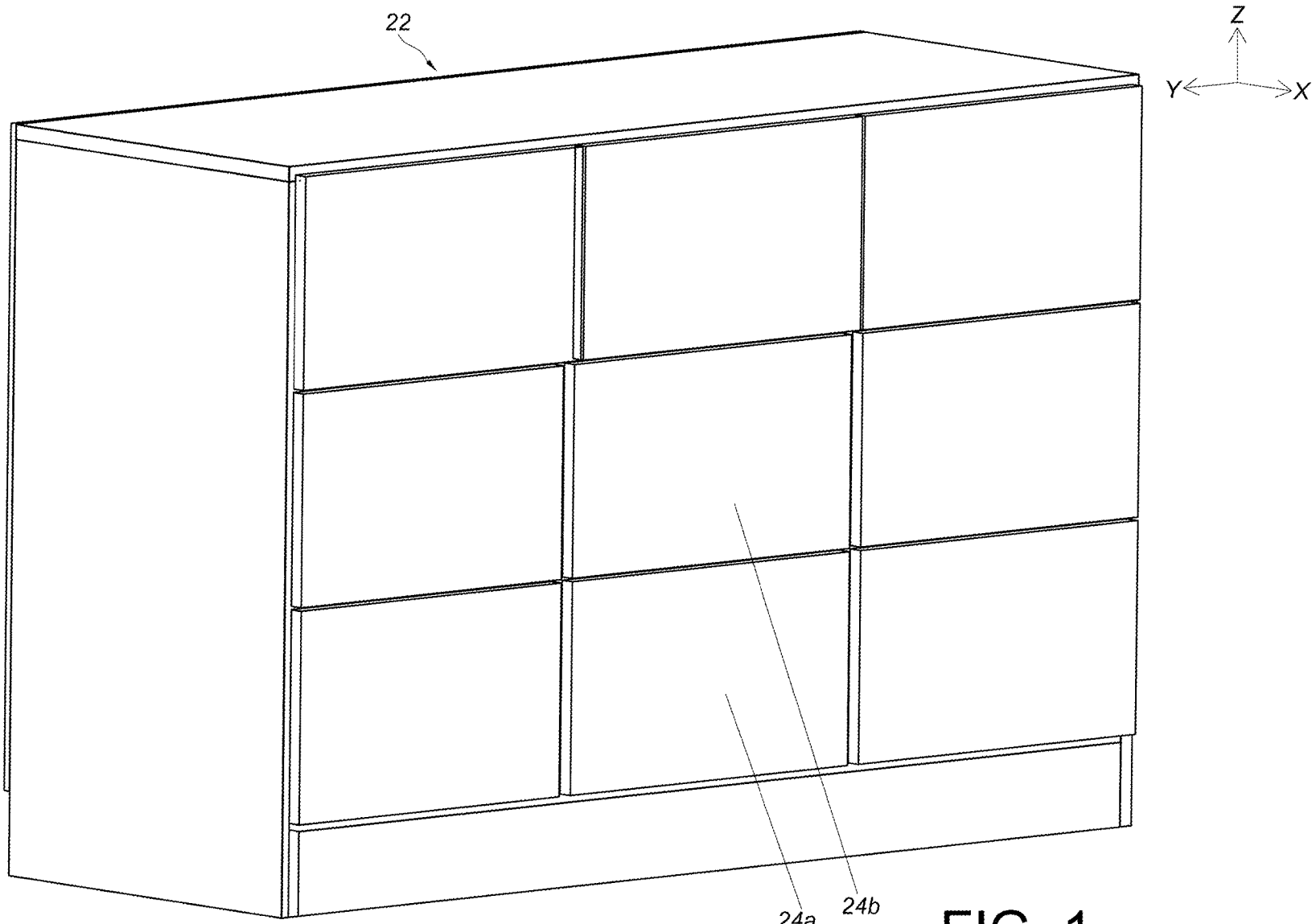
FIG. 1 is a schematic diagram of a cabinet apparatus according to an embodiment of the present invention.
Figure 2:
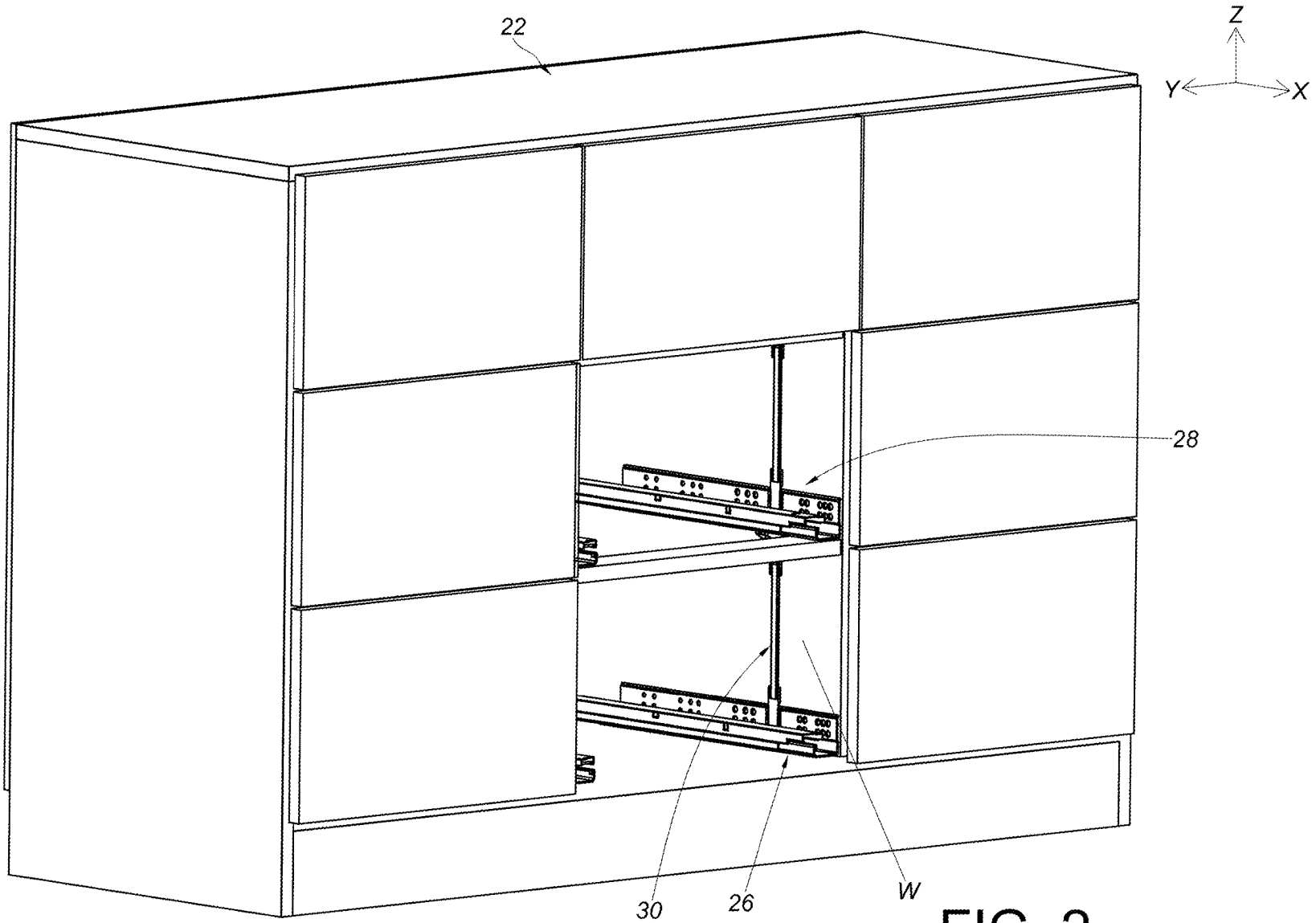
FIG. 2 is a partial diagram of the cabinet apparatus according to the embodiment of the present invention.

As shown in FIG. 1 and FIG. 2, a cabinet apparatus includes a cabinet 22 and a slide rail mechanism adapted for the cabinet 22. A plurality of drawers are arranged on the cabinet 22 along a vertical direction, i.e., a height direction of the cabinet 22, and/or a transverse direction, i.e., a lateral direction of the cabinet 22. In this embodiment, by way of example, a first drawer 24*a* and a second drawer 24*b* can be arranged on the cabinet 22 along the vertical direction. The slide rail mechanism includes a first slide rail assembly 26 and a second slide rail assembly 28. The first slide rail assembly 26 and a second slide rail assembly 28 are configured to be arranged on a wall W of the cabinet 22 for supporting the first drawer 24*a* and the second drawer 24*b* respectively. The slide rail mechanism further includes a connecting member 30 movably mounted on one of the cabinet 22, the first slide rail assembly 26 and the second slide rail assembly 28. In this embodiment, by way of example, the connecting member 30 can be movably mounted on the first slide rail assembly 26. However, the present invention is not limited to this embodiment.

Figure 3:
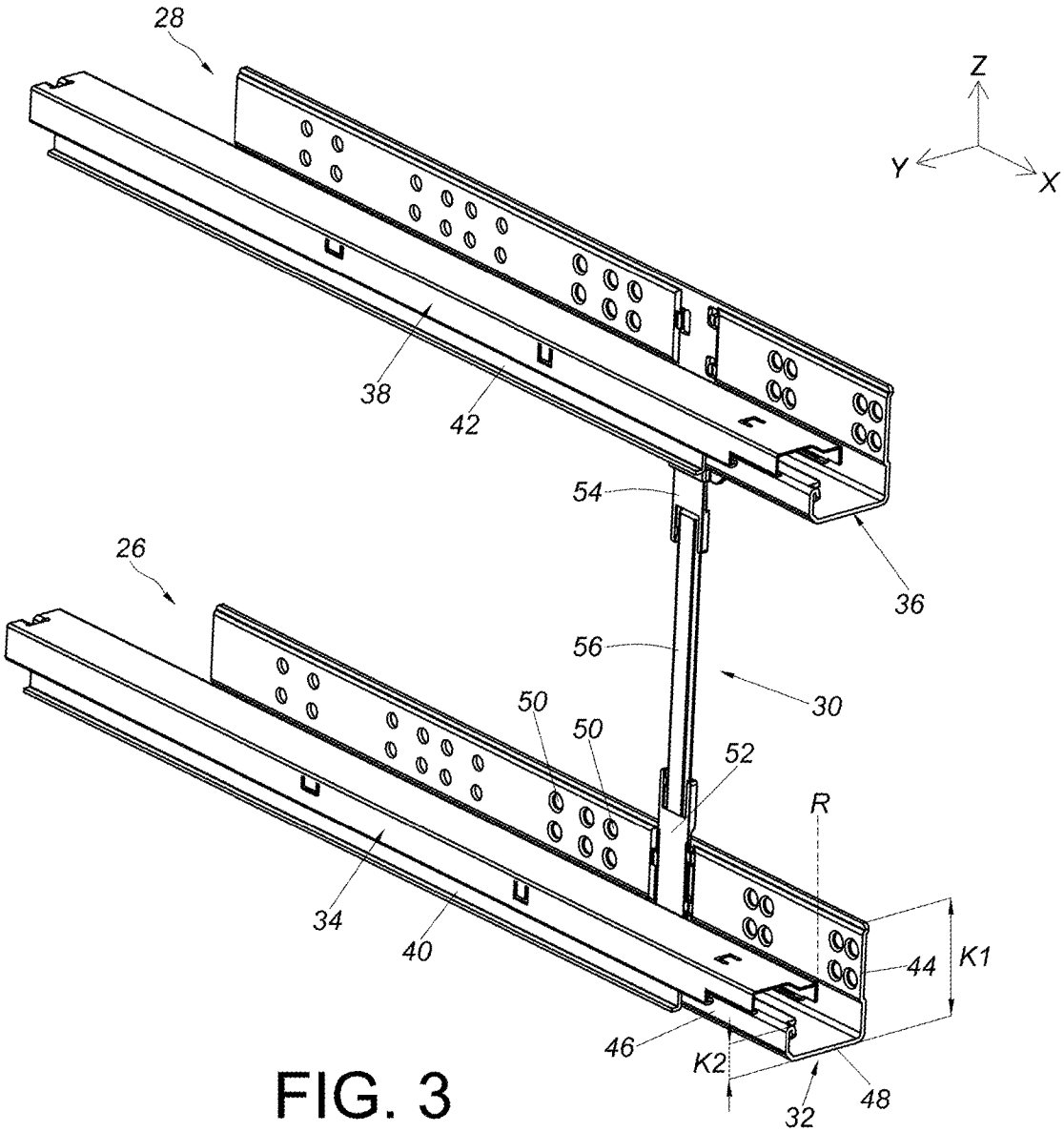
FIG. 3 is a diagram of a slide rail mechanism as a first slide rail assembly and a second slide rail assembly are retracted according to the embodiment of the present invention.
Figure 4:
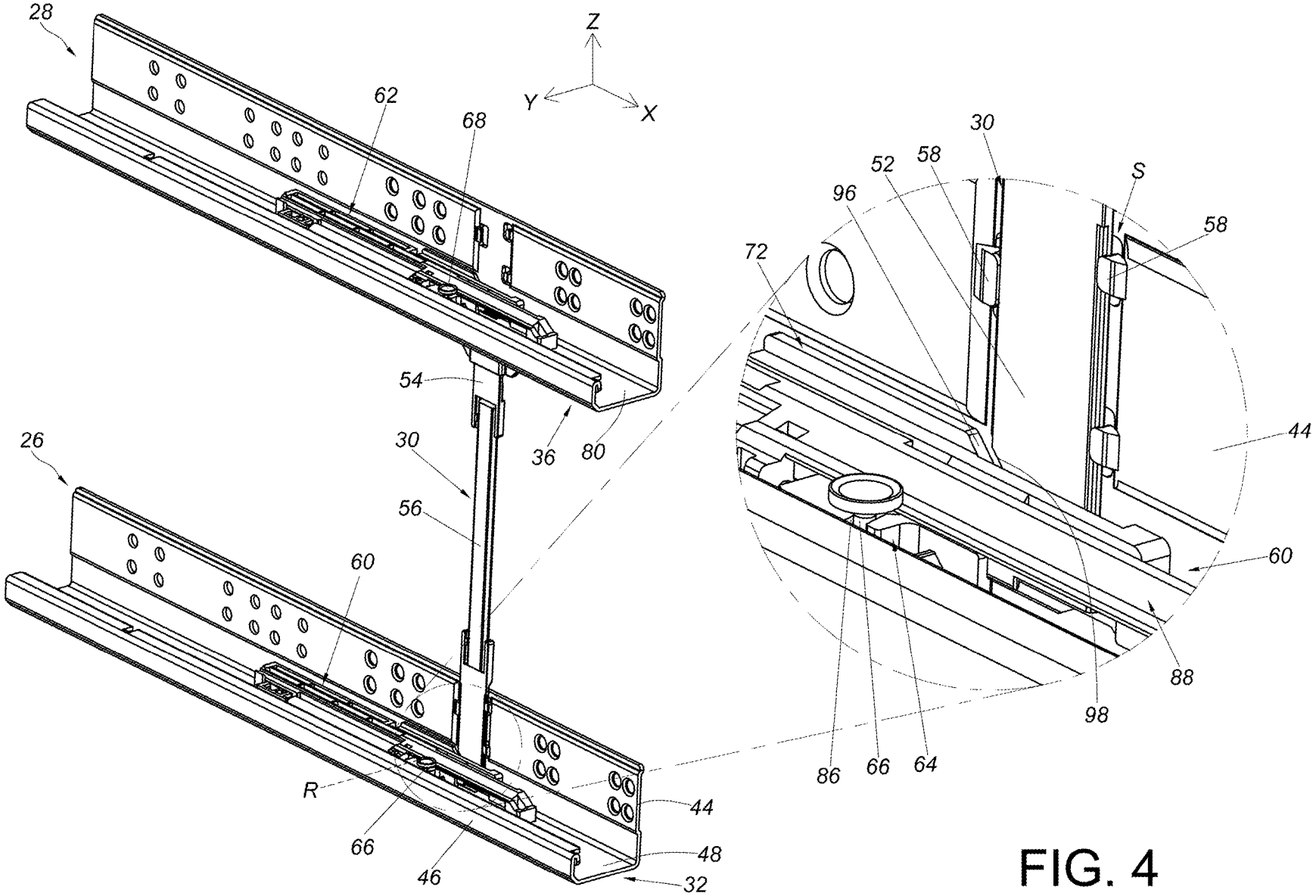
FIG. 4 is a partial diagram of the slide rail mechanism as the first slide rail assembly and the second slide rail assembly are retracted according to the embodiment of the present invention.
Figure 5:
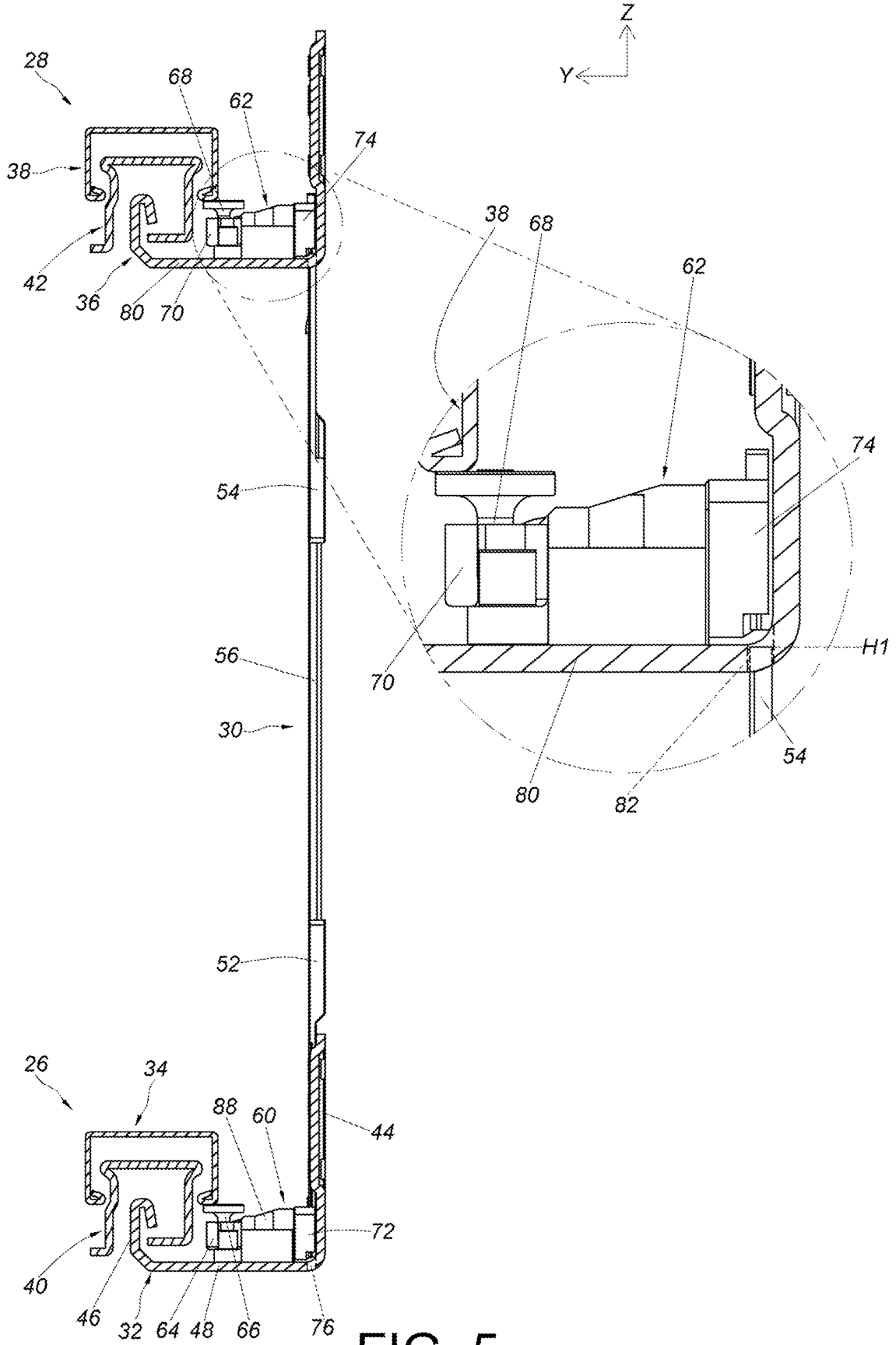
FIG. 5 is a sectional diagram of the slide rail mechanism as the first slide rail assembly and the second slide rail assembly are retracted according to the embodiment of the present invention.

As shown in FIG. 3 to FIG. 5, the first slide rail assembly 26 and the second slide rail assembly 28 can have substantially identical structures. For example, the first slide rail assembly 26 includes a first rail 32, e.g., a fixed rail, and a second rail 34, e.g., a movable rail, longitudinal displaceable with respect to the first rail 32, and the second slide rail assembly 28 includes a third rail 36, e.g., a fixed rail, and a fourth rail 38, e.g., a movable rail, longitudinal displaceable with respect to the third rail 36. Preferably, the first slide rail assembly 26 further includes a first middle rail 40 movably mounted between the first rail 32 and the second rail 34, and the second slide rail assembly 28 further includes a second middle rail 42 movably mounted between the third rail 36 and the fourth rail 38. The first middle rail 40 and the second middle rail 42 do not corporate with the connecting member 30. Understandably, in another embodiment, the first middle rail and the second middle rail can be omitted. It should be noticed that, in this embodiment, by way of example, a longitudinal direction, i.e., a length direction or a displacing direction of a rail, can be parallel to an X axis. The transverse direction, i.e., a lateral direction of the rail or the lateral direction of the cabinet 22, can be parallel to a Y axis. The vertical direction, i.e., a height direction of the rail or the height direction of the cabinet 22, can be parallel to the Z axis.

The connecting member 30 is movably mounted between the first slide rail assembly 26 and the second slide rail assembly 28.

Preferably, the first rail 32 of the first slide rail assembly 26 and the third rail 36 of the second slide rail assembly 28 can have substantially identical structures, and the second rail 34 of the first slide rail assembly 26 and the fourth rail 38 of the second slide rail assembly 28 can have substantially identical structures. Detailed description for the second slide rail assembly 28 is omitted for simplicity. In this embodiment, by way of example, the first rail 32 of the first slide rail assembly 26 can include a first vertical portion 44, a first supporting portion 46 and a first horizontal portion 48 connected between the first vertical portion 44 and the first supporting portion 46, and the first rail 32 of the first slide rail assembly 26 can be configured to be mounted on the wall W of the cabinet 22 by a plurality of mounting features 50 of the first vertical portion 44. The connecting member 30 is movably mounted on the first vertical portion 44 of the first rail 32, such that the connecting member 30 is movable along the height direction of the cabinet 22, e.g., the Z axis. Besides, the second rail 34 of the first slide rail assembly 26 and the fourth rail 38 of the second slide rail assembly 28 can be configured to support the first drawer 24*a* and the second drawer 24*b* respectively.

Preferably, the first vertical portion 44 and the first supporting portion 46 are substantially perpendicularly connected to the first horizontal portion 48. The first vertical portion 44 has a first height K1, and the first supporting portion 46 has a second height K2 less than the first height K1. The first vertical portion 44 and the first supporting portion 46 are located at two opposite sides of the first horizontal portion 48.

Preferably, each of the first slide rail assembly 26 and the second slide rail assembly 28 includes a plurality of slide-aiding devices. For example, the first slide rail assembly 26 includes a first slide-aiding device and a second slide-aiding device. The first slide-aiding device is movably supported between the first rail 32 and the first middle rail 40 of the first slide rail assembly 26 for facilitating a smooth relative displacement of the first middle rail 40 and the first rail 32 of the first slide rail assembly 26. The second slide-aiding device is movably supported between the second rail 34 and the first middle rail 40 of the first slide rail assembly 26 for facilitating a smooth relative displacement of the second rail 34 and the first middle rail 40 of the first slide rail assembly 26.

Furthermore, the connecting member 30 includes a first extending portion 52, a second extending portion 54 and a middle portion 56 connected between the first extending portion 52 and the second extending portion 54. As shown in FIG. 4, a predetermined space S is arranged on the first vertical portion 44 of the first rail 32 of the first slide rail assembly 26 and configured to at least partially accommodate the first extending portion 52 of the connecting member 30. Preferably, a plurality of retaining features 58 are further arranged on the first vertical portion 44 of the first rail 32 of the first slide rail assembly 26 and configured to retain or support the first extending portion 52 of the connecting member 30, so as to facilitate a stable movement of the connecting member 30 with respect to the first rail 32 of the first slide rail assembly 26.

Preferably, the connecting member 30 is a rod, and a longitudinal direction of the connecting member 30 is substantially parallel to the height direction of the cabinet 22.

Preferably, a first self-closing device 60 and a second self-closing device 62 are arranged on the first slide rail assembly 26 and the second slide rail assembly 28, respectively. The first self-closing device 60 and the second self-closing device 62 can have substantially identical structures. Detailed description for the second self-closing device 62 is omitted for simplicity. The first self-closing device 60 is arranged on the first rail 32 of the first slide rail assembly 26 and includes a first auxiliary member 64, and the second self-closing device 62 is arranged on the third rail 36 of the second slide rail assembly 28 and includes a third auxiliary member 70.

Preferably, a first working feature 66 is arranged on the second rail 34 of the first slide rail assembly 26 and movable together with the second rail 34 of the first slide rail assembly 26 when the second rail 34 of the first slide rail assembly 26 displaces with respect to the first rail 32 of the first slide rail assembly 26, and a second working feature 68 is arranged on the fourth rail 38 of the second slide rail assembly 28 and movable together with the fourth rail 38 of the second slide rail assembly 28 when the fourth rail 38 of the second slide rail assembly 28 displaces with respect to the third rail 36 of the second slide rail assembly 28. In this embodiment, by way of example, each of the first working feature 66 and the second working feature 68 can be a protrusion, a pin or the like. However, the present invention is not limited to this embodiment. As shown in FIG. 3 and FIG. 4, when the first slide rail assembly 26 is retracted, the second rail 34 of the first slide rail assembly 26 is located at a first retracted position R with respect to the first rail 32 of the first slide rail assembly 26, and the first auxiliary member 64 of the first self-closing device 60 releasably catches the first working feature 66 on the second rail 34 of the first slide rail assembly 26. Understandably, when the second slide rail assembly 28 is retracted, the fourth rail 38 of the second slide rail assembly 28 is located at a second retracted position with respect to the third rail 36 of the second slide rail assembly 28, and the third auxiliary member 70 of the second self-closing device 62 releasably catches the second working feature 68 on the fourth rail 38 of the second slide rail assembly 28.

Preferably, the first self-closing device 60 further includes a second auxiliary member 72 located adjacent to the first auxiliary member 64, and the second self-closing device 62 further includes a fourth auxiliary member 74 located adjacent to the third auxiliary member 70.

Preferably, as shown in FIG. 5, a first through hole 76 is arranged on the first rail 32 of the first slide rail assembly 26, e.g., the first horizontal portion 48 of the first rail 32 of the first slide rail assembly 26, and a second through hole 82 is arranged on the third rail 36 of the second slide rail assembly 28, e.g., a second horizontal portion 80 of the third rail 36 of the second slide rail assembly 28.

As shown in FIG. 4 and FIG. 5, when the second rail 34 of the first slide rail assembly 26 is located at the first retracted position R with respect to the first rail 32 of the first slide rail assembly 26 and the fourth rail 38 of the second slide rail assembly 28 is located at the second retracted position with respect to the third rail 36 of the second slide rail assembly 28, the connecting member 30 is located at a first predetermined position H1. Besides, when the connecting member 30 is located at the first predetermined position H1, the connecting member 30, e.g., the second extending portion 54 of the connecting member 30, does not block the fourth auxiliary member 74 of the second self-closing device 62.

Figure 6:
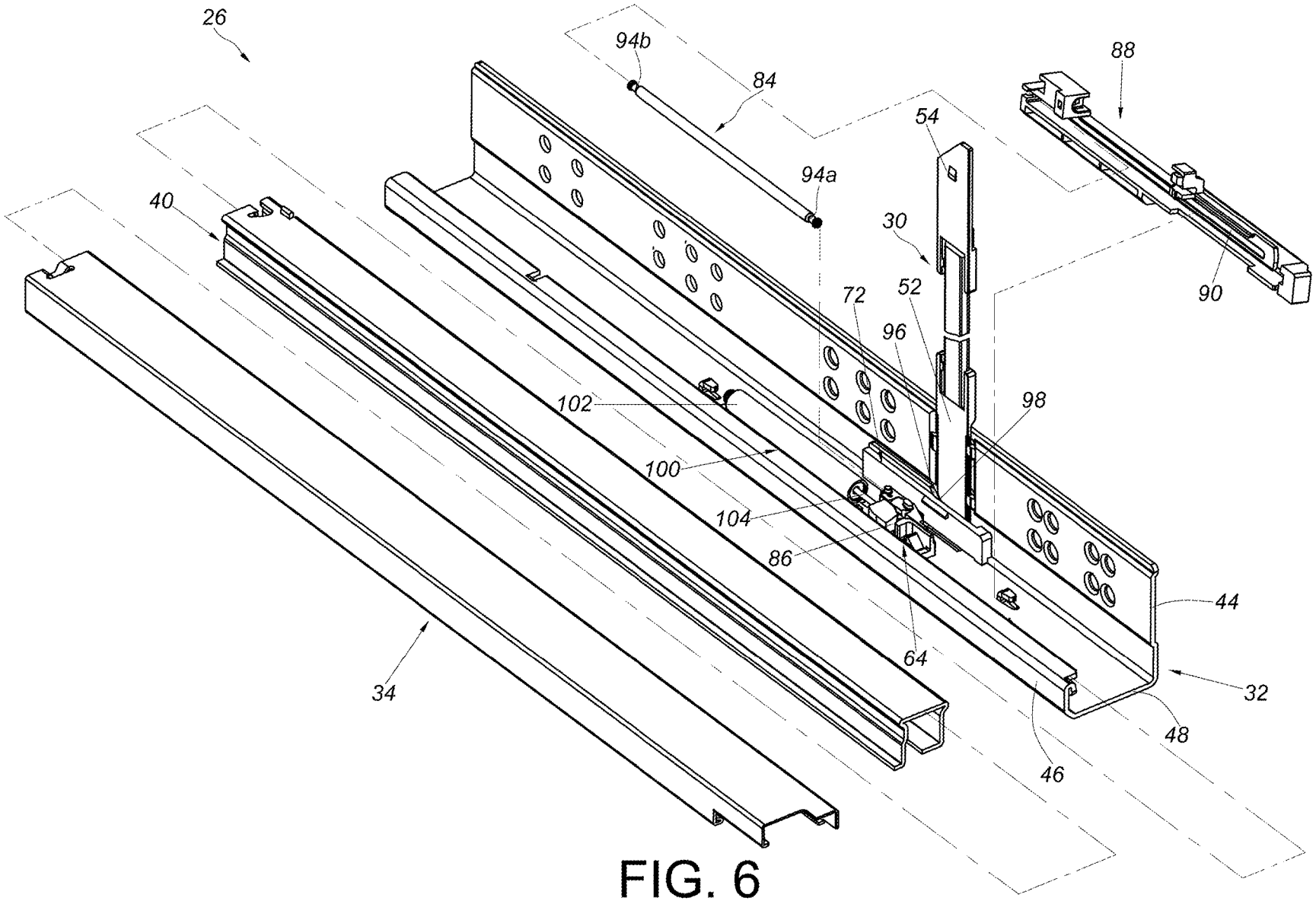
FIG. 6 is a partial exploded diagram of the slide rail mechanism according to the embodiment of the present invention.

As shown in FIG. 6, the first self-closing device 60 further includes a first resilient member 84 configured to provide a resilient force to the first auxiliary member 64 and/or the second auxiliary member 72. In this embodiment, by way of example, the first resilient member 84 can be a compression spring or an extension spring. However, the present invention is not limited to this embodiment. As shown in FIG. 4, the first auxiliary member 64 includes a first catch portion 86 configured to releasably catch the first working feature 66 on the second rail 34 of the first slide rail assembly 26. In this embodiment, by way of example, as shown in FIG. 4, the first catch portion 86 can be a hook having an auxiliary space configured to receive a portion of the first working feature 66. However, the present invention is not limited to this embodiment.

Preferably, the first self-closing device 60 further includes a first base 88 configured to be connected, e.g., fixedly connected, to the first rail 32, e.g., the first horizontal portion 48 of the first rail 32, of the first slide rail assembly 26.

Preferably, the first resilient member 84 includes a first end portion 94*a* connected to the second auxiliary member 72 and a second end portion 94*b* connected to the first base 88.

Preferably, one of the first auxiliary member 64 and the second auxiliary member 72 includes a first guiding feature 96. In this embodiment, by way of example, the second auxiliary member 72 includes the first guiding feature 96. However, the present invention is not limited to this embodiment. Besides, the connecting member 30, e.g., the first extending portion 52 of the connecting member 30, includes a second guiding feature 98 for cooperating with the first guiding feature 96 to allow the connecting member 30 to be moved in response to the second auxiliary member 72. In this embodiment, by way of example, as shown in FIG. 4, at least one of the first guiding feature 96 and the second guiding feature 98 can be an inclined surface or an arc surface. However, the present invention is not limited to this embodiment.

Preferably, the first slide rail assembly 26 further includes a first damping device 100, and the second slide rail assembly 28 further includes a second damping device. The first damping device 100 and the second damping device can have substantially identical structures. Detailed description for the second damping device is omitted for simplicity. The first damping device 100 includes a first object 102 and a second object 104 movable with respect to each other. One of the first object 102 and the second object 104 is a cylinder equipped with a buffering medium and/or an auxiliary spring therein, and the other one of the first object 102 and the second object 104 is a piston rod. As shown in FIG. 6, the first damping device 100 is located at a position corresponding to the first auxiliary member 64. When the second rail 34 of the first slide rail assembly 26 is displaced with respect to the first rail 32 of the first slide rail assembly 26 to the first retracted position R, one of the first object 102 and the second object 104 can abut against the first auxiliary member 64 to reduce a displacing speed of the second rail 34 of the first slide rail assembly 26. In this embodiment, by way of example, the second object 104 can be configured to abut against the first auxiliary member 64.

Figure 7:
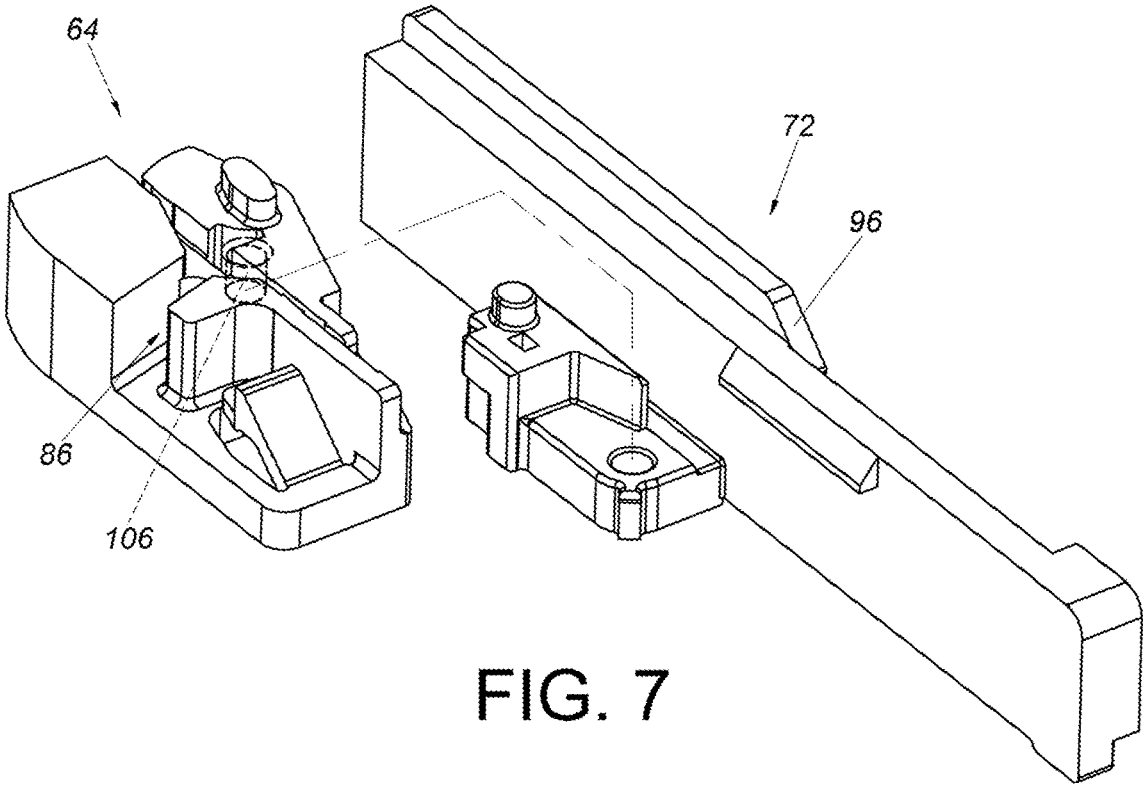
FIG. 7 is a diagram of a first self-closing device as a first auxiliary member is detached from the second auxiliary member according to the embodiment of the present invention.
Figure 8:
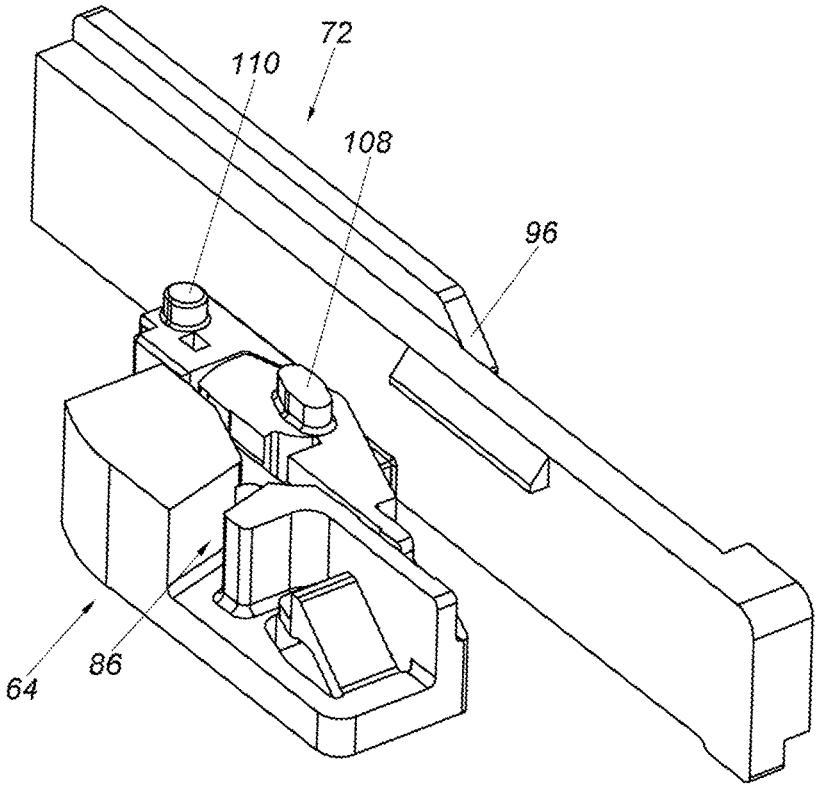
FIG. 8 is a diagram of the first self-closing device as the first auxiliary member and the second auxiliary member are assembled with each other according to the embodiment of the present invention.

As shown in FIG. 7 and FIG. 8, the first auxiliary member 64 and the second auxiliary member 72 are connected to each other. In this embodiment, by way of example, the first auxiliary member 64 and the second auxiliary member 72 can be pivotally connected to each other via a shaft 106. However, the present invention is not limited to this embodiment. Identically, the third auxiliary member 70 and the fourth auxiliary member 74 can be pivotally connected to each other. However, the present invention is not limited to this embodiment.

Preferably, the first auxiliary member 64 includes a first supporting section 108, and the second auxiliary member 72 includes a second supporting section 110. The first supporting section 108 and the second supporting section 110 are configured to cooperate with the first base 88. In this embodiment, by way of example, each of the first supporting section 108 and the second supporting section 110 can be a protruding portion.

Figure 9:
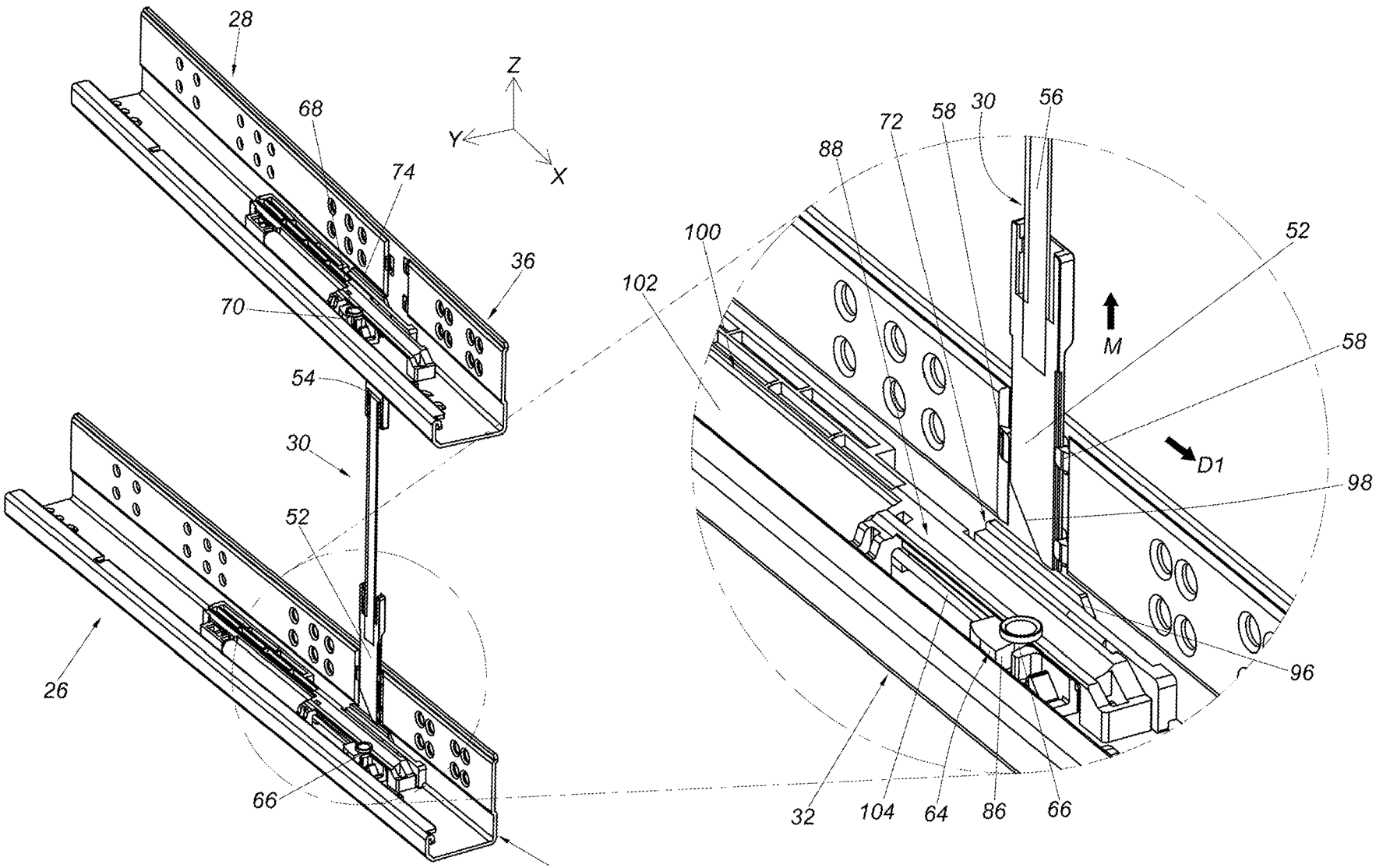
FIG. 9 is a diagram of the slide rail mechanism as a connecting member is driven to a second predetermined position by a second rail of the first slide rail assembly displacing with respect to a first rail of the first slide rail assembly to a first extended position according to the embodiment of the present invention.

For illustration purpose, FIG. 9 illustrates the first working feature 66, which is arranged on the second rail 34 of the first slide rail assembly 26, and the second working feature 68, which is arranged on the fourth rail 38 of the second slide rail assembly 28, without the first middle rail 40 and the second rail 34 of the first slide rail assembly 26 and the second middle rail 42 and the fourth rail 38 of the second slide rail assembly 28.

When the second rail 34 of the first slide rail assembly 26 displaces with respect to the first rail 32 of the first slide rail assembly 26 along an opening direction D1, the connecting member 30 is moved for preventing the fourth rail 38 of the second slide rail assembly 28 from displacing with respect to the third rail 36 of the second slide rail assembly 28 along the opening direction D1.

Figure 10:
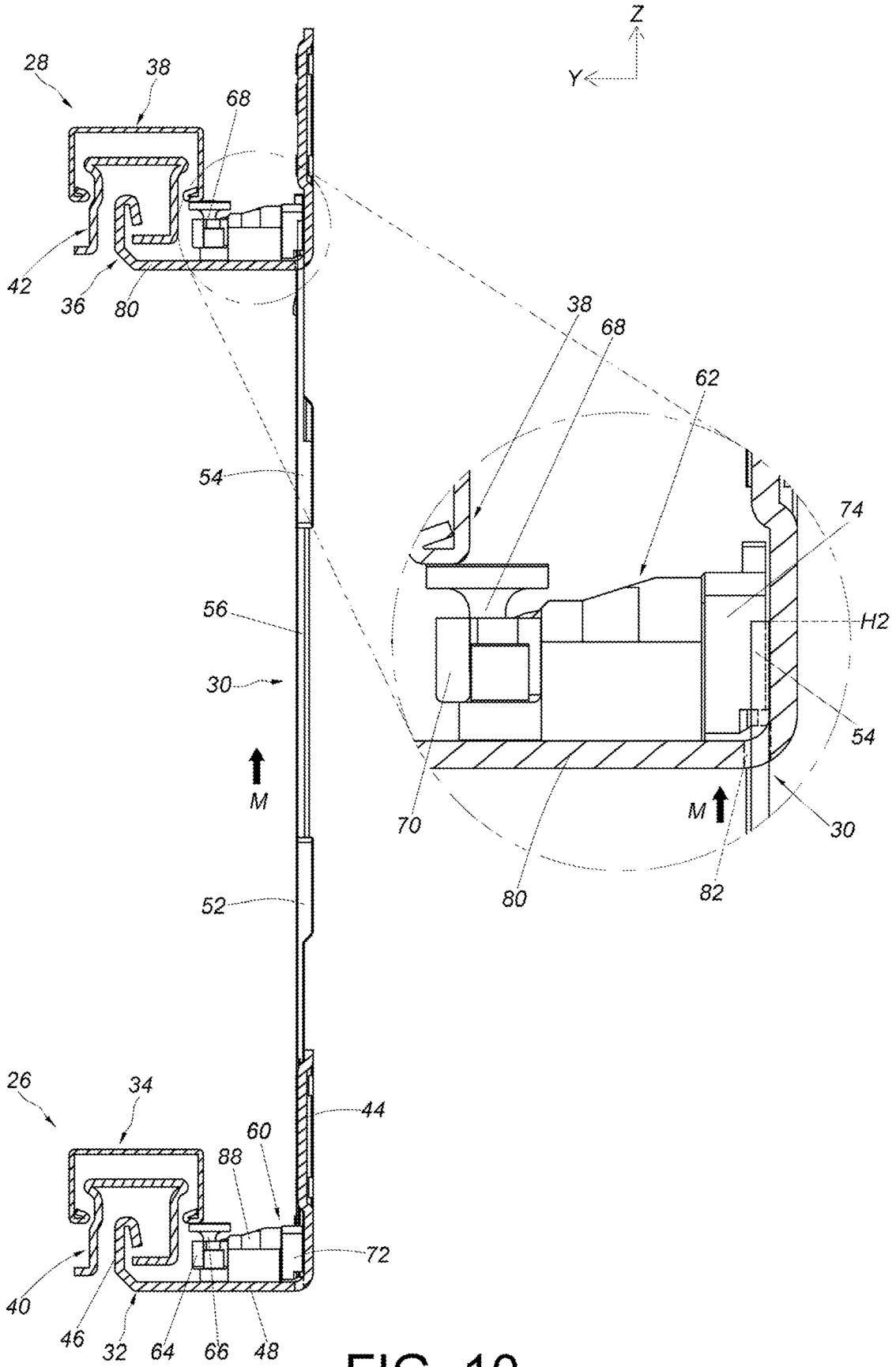
FIG. 10 is a sectional diagram of the slide rail mechanism as the connecting member is driven to the second predetermined position by the second rail of the first slide rail assembly displacing with respect to the first rail of the first slide rail assembly to the first extended position according to the embodiment of the present invention.

For example, when the second rail 34 of the first slide rail assembly 26 displaces with respect to the first rail 32 of the first slide rail assembly 26 away from the first retracted position R as shown in FIG. 3 along the opening direction D1 to drive the first working feature 66 from a position as shown in FIG. 4 to a position as shown in FIG. 9, the first working feature 66 is caught by the first auxiliary member 64 moving together with the second rail 34 of the first slide rail assembly 26, such that the first auxiliary member 64 and the second auxiliary member 72 are moved in response to the displacement of the second rail 34 of the first slide rail assembly 26. Accordingly, the connecting member 30 can be driven from the first predetermined position H1 as shown in FIG. 5 to a second predetermined position H2 as shown in FIG. 10 along a height direction M by an abutment of the first guiding feature 96 of the second auxiliary member 72 and the second guiding feature 98 of the connecting member 30, e.g., the first extending portion 52 of the connecting member 30. When the connecting member 30 is located at the second predetermined position H2 as shown in FIG. 10, the connecting member 30, e.g., the second extending portion 54 of the connecting member 30, passes through the second through hole 82 on the third rail 36 of the second slide rail assembly 28, e.g., the second horizontal portion 80 of the third rail 36 of the second slide rail assembly 28, so as to block the fourth auxiliary member 74 for preventing the fourth rail 38 of the second slide rail assembly 28 from displacing with respect to the third rail 36 of the second slide rail assembly 28 along the opening direction D1, i.e., retaining the fourth rail 38 of the second slide rail assembly 28 at a second retracted position as shown in FIG. 5. Accordingly, the second drawer 24*b* cannot be opened with respect to the cabinet 22 respectively because the fourth rail 38 of the second slide rail assembly 28 is restrained from displacing with respect to the third rail 36 of the second slide rail assembly 28 along the opening direction D1.

Figure 12:
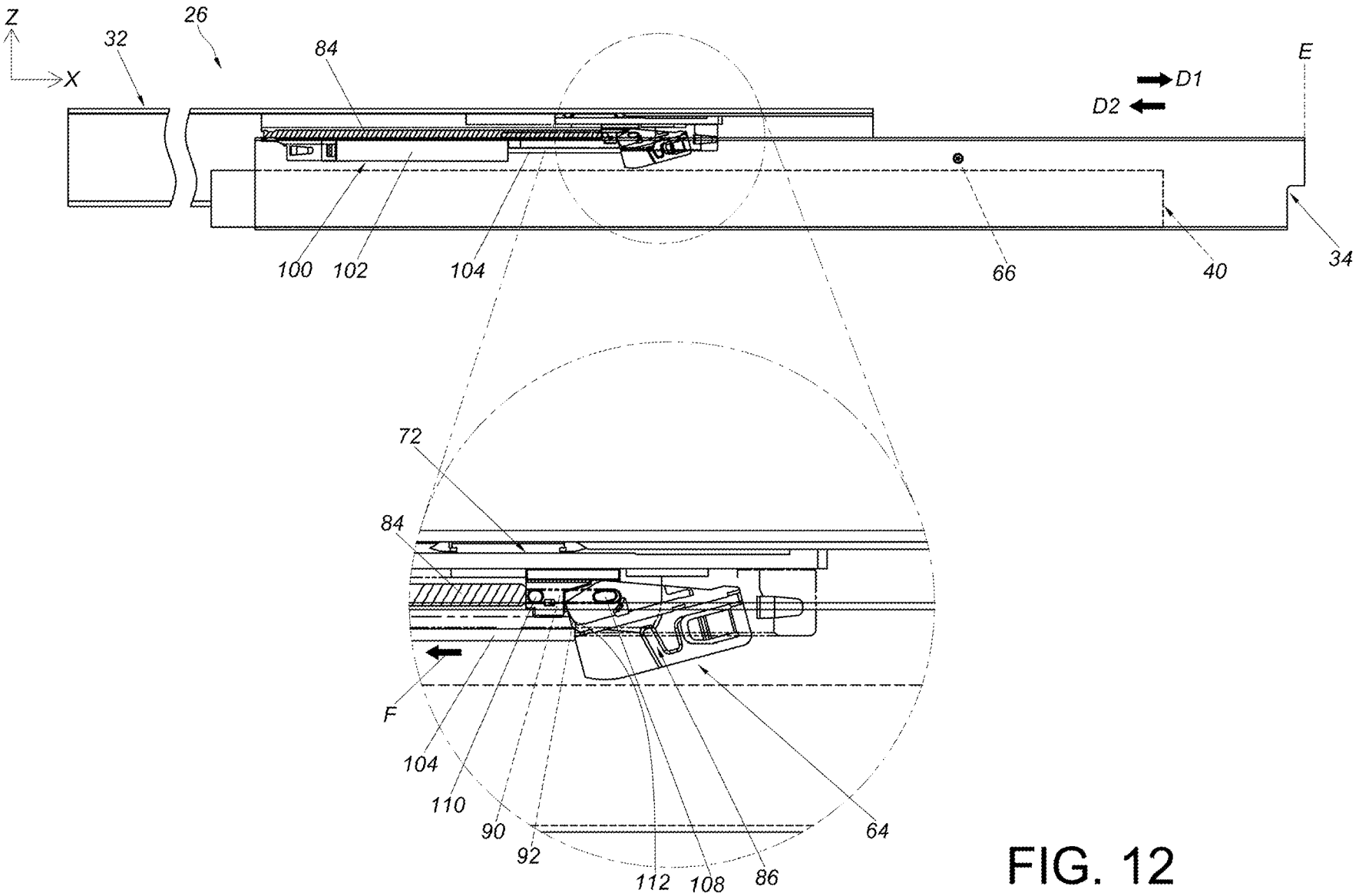
FIG. 12 is a diagram of the slide rail mechanism as the first self-closing device is in a second state according to the embodiment of the present invention.

As shown in FIG. 0.11 and FIG. 12, the first supporting section 108 of the first auxiliary member 64 and the second supporting section 110 of the second auxiliary member 72 are located in a longitudinal path 90 of the first base 88. Preferably, the first base 88 further includes a bending path 92 bent with respect to the longitudinal path 90. The first auxiliary member 64 moves along the longitudinal path 90 and the bending path 92.

Figure 11:
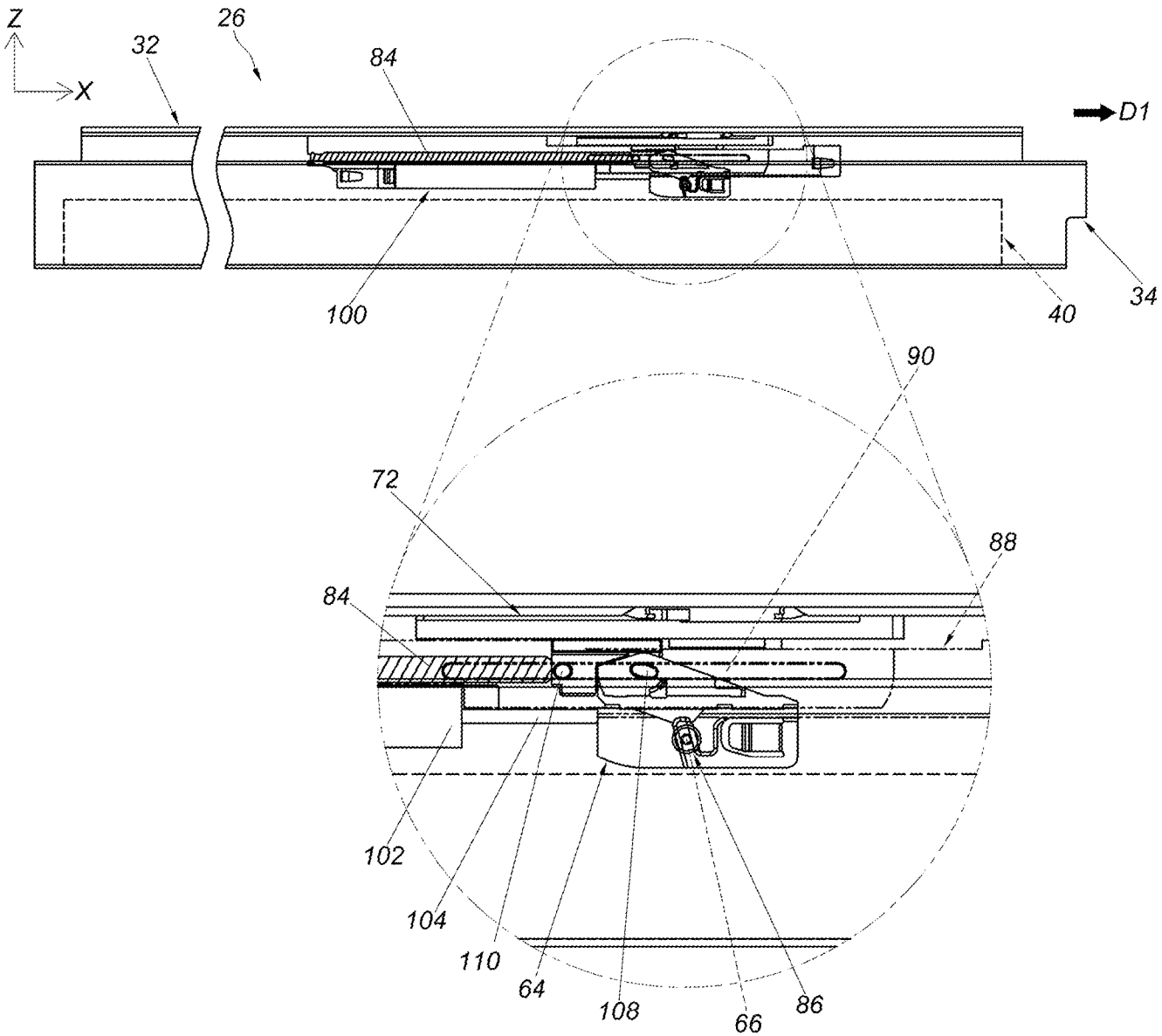
FIG. 11 is a diagram of the slide rail mechanism as the first self-closing device is in a first state according to the embodiment of the present invention.

When the second rail 34 of the first slide rail assembly 26 displaces with respect to the first rail 32 of the first slide rail assembly 26 from a position as shown in FIG. 11 to a first extended position E as shown in FIG. 12 along the opening direction D1, the first auxiliary member 64 is driven by the first working feature 66 caught by the first auxiliary member 64 to pivot to an engaging position as shown in FIG. 12 with respect to the second auxiliary member 72 through the bending path 92 and then is disengaged from the first working feature 66. In this embodiment, by way of example, as shown in FIG. 12, the first auxiliary member 64 can include a corresponding supporting section 112 configured to engage with a wall of the bending path 94 to retain the first auxiliary member 64 at the pivoting position for maintaining a resilient deformation of the resilient member 84. Besides, when the second rail 34 of the first slide rail assembly 26 is located at the first extended position E, the second object 104 is fully extended with respect to the first object 102, i.e., the first damping device 100 is in a pre-buffering state.

It should be noticed that, as shown in FIG. 12, when the second rail 34 of the first slide rail assembly 26 displaces with respect to the first rail 32 of the first slide rail assembly 26 away from the first extended position E along a retracting direction D2 for a predetermined distance, the corresponding supporting section 112 of the first auxiliary member 64 is driven to pivot to a disengaging position as shown in FIG. 11 by an abutment of the first auxiliary member 64 and the first working feature 66 for disengaging from the wall of the bending path 92 and for catching the first working feature 66 by the first catch portion 86 of the first auxiliary member 64, such that the second rail 34 can be driven to the first retracted position R along the retracting direction D2 by the resiliently deformed first resilient member 84.

Preferably, during a displacement of the second rail 34 driven by the resilient member 84 and displacing to the first retracted position R along the retracting direction D2, the first auxiliary member 64 abuts against the second object 104 of the first damping device 100 for driving the second object 104 of the first damping device 100 to move with respect to the first object 102 of the first damping device 100, such that the displacing speed of the second rail 34 is reduced.

It should be noticed that when the second rail 34 of the first slide rail assembly 26 is retracted with respect to the first rail 32 of the first slide rail assembly 26 and the fourth rail 38 of the second slide rail assembly 28 is opened or extended with respect to the third rail 36 of the second slide rail assembly 28, the fourth auxiliary member 74 moves to a blocking position along the opening direction D1 for blocking the connecting member 30, such that the connecting member 30 cannot move along the height direction M, i.e., the connecting member 30 can be retained at the first predetermined height H1. The connecting member 30 retained at the first predetermined height H1 can block the second auxiliary member 72 for preventing the second rail 34 of the first slide rail assembly 26 from displacing with respect to the first rail 32 of the first slide rail assembly 26 along the opening direction D1.

From the above, the slide rail mechanism includes the following characteristics.

1. The connecting member 30 is movably mounted on one of the cabinet 22, the first slide rail assembly 26 and the second slide rail assembly 28. When the connecting member 30 is movably mounted on the first slide rail assembly 26, e.g., the first rail 32 of the first slide rail assembly 26, the cabinet 22 does not need to be equipped with any additional structure for mounting the connecting member 30. Therefore, the slide rail mechanism has an advantage of easy assembly.
2. The connecting member 30 is configured to cooperate with the second auxiliary member 72 of the self-closing device 60 movably connected to the first auxiliary member 64. Therefore, the slide rail mechanism has advantages of simplified structure and improved operability.

3. When the second rail 34 of the first slide rail assembly 26 is opened or extended with respect to the first rail 32 of the first slide rail assembly 26, the fourth rail 38 of the second slide rail assembly 28 cannot be extended with respect to the third rail 36 of the second slide rail assembly 28. When the fourth rail 38 of the second slide rail assembly 28 is opened or extended with respect to the third rail 36 of the second slide rail assembly 28, the second rail 34 of the first slide rail assembly 26 cannot be extended with respect to the first rail 32 of the first slide rail assembly 26. Accordingly, the first drawer 24*a* and the second drawer 24*b* cannot be opened with respect to the cabinet 22 at the same time, which prevents falling of the cabinet 22 caused by the opened first drawer 24*a* and the opened second drawer 24*b*. Therefore, the slide rail mechanism provides an enhanced using safety.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A slide rail mechanism adapted for a cabinet, the slide rail mechanism comprising:

a first slide rail assembly arranged on the cabinet, the first slide rail assembly comprising a first rail, a second rail longitudinally displaceable with respect to the first rail, and a self-closing device arranged on the first rail;

a second slide rail assembly arranged on the cabinet, the second slide rail assembly comprising a third rail and a fourth rail longitudinally displaceable with respect to the third rail; and a connecting member movably mounted on one of the cabinet and the first rail;

wherein the connecting member is moved for preventing the fourth rail from displacing with respect to the third rail along an opening direction when the second rail displaces with respect to the first rail along the opening direction;

wherein the self-closing device comprises a first auxiliary member, a second auxiliary member and a resilient member, the second rail drives the first auxiliary member to resiliently deform the resilient member during a displacement of the second rail with respect to the first rail from a retracted position to an extended position along the opening direction, the second rail is allowed to be driven to the retracted position along a retracting direction by the resilient member when the second rail displaces with respect to the first rail from the extended position along the retracting direction for a predetermined distance, and the second rail drives one of the first auxiliary member and the second auxiliary member to move the connecting member for preventing the fourth rail from displacing with respect to the third rail along the opening direction during the displacement of the second rail with respect to the first rail from the retracted position to the extended position along the opening direction.

2. The slide rail mechanism of claim 1, wherein the first rail comprises a vertical portion, a supporting portion and a horizontal portion connected between the vertical portion and the supporting portion, and the connecting member is movably mounted on the vertical portion of the first rail and movable along a height direction.

3. The slide rail mechanism of claim 2, wherein the vertical portion and the supporting portion are substantially perpendicularly connected to the horizontal portion, the vertical portion has a first height along the height direction, and the supporting portion has a second height along the height direction less than the first height.

4. The slide rail mechanism of claim 3, wherein the vertical portion is configured to be mounted on the cabinet.

5. The slide rail mechanism of claim 1, wherein the second auxiliary member and the first auxiliary member are pivotally connected to each other, the self-closing device further comprises a base, and a longitudinal path and a bending path bent from the longitudinal path are formed on the base and for allowing the first auxiliary member to move.

6. The slide rail mechanism of claim 1, wherein the first slide rail assembly further comprises a damping device, and the damping device is configured to reduce a displacing speed of the second rail during a displacement of the second rail driven by the resilient member and displacing to the retracted position along the retracting direction.

7. The slide rail mechanism of claim 6, wherein the damping device further comprises a first object and a second object movable with respect to each other.

8. The slide rail mechanism of claim 1, wherein the first slide rail assembly further comprises a middle rail movably mounted between the first rail and the second rail.

9. A slide rail mechanism comprising:

a first slide rail assembly comprising a first rail, a second rail longitudinally displaceable with respect to the first rail, and a self-closing device arranged on the first rail, and the self-closing device comprising a resilient member, a first auxiliary member and a second auxiliary member;

a second slide rail assembly comprising a third rail and a fourth rail longitudinally displaceable with respect to the third rail; and a connecting member;

wherein the connecting member is moved for preventing the fourth rail from displacing with respect to the third rail along an opening direction and the resilient member is resiliently deformed during a displacement of the second rail with respect to the first rail from a retracted position to an extended position along the opening direction;

wherein the second rail is configured to be driven to the retracted position along a retracting direction by the resilient member during a displacement of the second rail with respect to the first rail from the extended position along the retracting direction;

wherein the second rail drives the first auxiliary member to resiliently deform the resilient member during the displacement of the second rail with respect to the first rail from the retracted position to the extended position along the opening direction, and the second rail drives one of the first auxiliary member and the second auxiliary member to move the connecting member for preventing the fourth rail from displacing with respect to the third rail along the opening direction during the displacement of the second rail with respect to the first rail from the retracted position to the extended position along the opening direction.

10. The slide rail mechanism of claim 9, wherein the first rail comprises a vertical portion, a supporting portion and a horizontal portion connected between the vertical portion and the supporting portion, and the connecting member is movably mounted on the vertical portion of the first rail and movable along a height direction.

11. The slide rail mechanism of claim 10, wherein the vertical portion and the supporting portion are substantially perpendicularly connected to the horizontal portion.

12. The slide rail mechanism of claim 11, wherein the vertical portion has a first height along the height direction, and the supporting portion has a second height along the height direction less than the first height.

13. The slide rail mechanism of claim 9, wherein the second auxiliary member and the first auxiliary member are pivotally connected to each other, the self-closing device further comprises a base, and a longitudinal path and a bending path bent from the longitudinal path are formed on the base and for allowing the first auxiliary member to move.

14. The slide rail mechanism of claim 9, wherein the first slide rail assembly further comprises a damping device, and the damping device is configured to reduce a displacing speed of the second rail during a displacement of the second rail driven by the resilient member and displacing to the retracted position along the retracting direction.

15. The slide rail mechanism of claim 14, wherein the damping device further comprises a first object and a second object movable with respect to each other.

16. The slide rail mechanism of claim 9, wherein the first slide rail assembly further comprises a middle rail movably mounted between the first rail and the second rail.

* * * * *